United States Patent [19]

Bayer et al.

[11] 4,314,699

[45] Feb. 9, 1982

[54] GAME RACQUET

[75] Inventors: Raymond M. Bayer, San Diego, Calif.; Robert E. Rodgers, Houston, Tex.

[73] Assignee: Leach Industries, San Diego, Calif.

[21] Appl. No.: 116,213

[22] Filed: Jan. 28, 1980

[51] Int. Cl.[3] ..... A63B 49/12

[52] U.S. Cl. ..... 273/73 D; 273/73 C; 273/73 H

[58] Field of Search ..... 273/73 R, 73 C, 73 D, 273/73 F, 73 G, 73 H, 73 J, 75

[56] References Cited

U.S. PATENT DOCUMENTS

| | | | |
|---|---|---|---|
| 1,583,309 | 5/1926 | Reach | 273/73 J |
| 2,141,824 | 12/1938 | Ranger | 273/73 H |
| 2,171,223 | 8/1939 | Robinson | 273/73 H |
| 2,642,283 | 2/1972 | Wilkens | 273/73 D X |
| 3,547,440 | 12/1970 | Deer | 273/73 D |
| 3,582,072 | 6/1971 | Stueck | 273/73 J |
| 3,582,073 | 6/1971 | Melnick et al. | 273/73 D |
| 3,664,668 | 5/1972 | Held | 273/73 D X |
| 3,724,850 | 4/1973 | Stevens | 273/73 D X |
| 4,066,260 | 1/1978 | Rodgers | 273/73 C |
| 4,204,681 | 5/1980 | Hall et al. | 273/73 C |

*Primary Examiner*—Richard J. Apley

*Attorney, Agent, or Firm*—LeBlanc, Nolan, Shur & Nies

[57] ABSTRACT

A game racquet has a composite metal-plastic frame intermediately defining a head and having opposite ends within a handle, there being external plastic strips laterally located on the head, a wide strip around the outer part of the head and narrower strips extending from opposite ends of the wide strip into the handle, and the handle comprising a housing wherein the frame ends are secured together and to the housing and wherein the remaining space is occupied by foamed polyurethane.

4 Claims, 9 Drawing Figures

GAME RACQUET

This invention relates to game racquets and particularly to novel racquetball racquets having special structural detail.

In its preferred embodiment the invention comprises improvement over the racquetball racquet disclosed in U.S. Pat. No. 4,066,260. That patent discloses a laminated composite metal-plastic frame having a permanently bonded continuous outer plastic bumper strip.

The invention contemplates a laminated metal-plastic composite racquet frame having external plastic strips of different size secured thereon, namely a wider strip extending around the outer end of the head to provide both string protection and bumper protection where needed, and narrower lighter weight strips through the throat affording string protection but where bumper protection is not needed, and this is a major object.

A further object of the invention is to provide a novel racquet wherein a composite frame comprising an inwardly open metal channel within which is bonded a synthetic plastic core is formed with a continuous longitudinal outwardly open groove along the base of the channel, a wide strip of synthetic plastic internally fitted within the groove and extending laterally over the entire channel base is mounted on the outer part of the head and narrower strips of synthetic plastic disposed wholly in the groove extend from opposite ends of the wider strip into the handle structure.

Further to the foregoing object these strips have internal locating projections fitted into depressions along the bottom of the groove, and the strips are maintained on the frame by tension of the head stringing.

Another object of the invention is to provide a novel racquet having special structural detail in the handle structure.

Further objects of the invention will appear as the description proceeds in association with the appended claims and the accompanying drawings.

PREFERRED EMBODIMENTS

Figure 1:
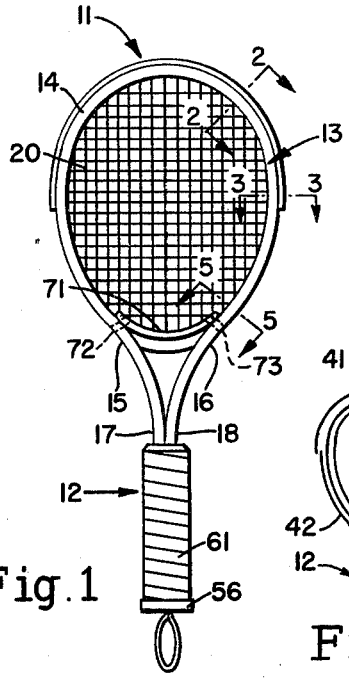
FIG. 1 is a side elevation showing a racquet ball racquet according to a preferred embodiment of the invention.

The racquet shown in FIG. 1 consists of a ball striking head 11 having a handle 12 at its inner end. The structure is laminated essentially comprising a single length metal frame member 13 of suitable cross section bent intermediate its ends at 14 to the desired head outline and with its opposite ends reversely bent at 15, 16 to define opposed throat portions and with its terminals 17, 18 extending side by side in parallel relation into a handle structure to be described in more detail.

Metal frame member 13 is a single strip of formed metal of constant cross section from end to end. It is a channel that is open inwardly in the racquet assembly. Preferably it is an extruded strip of aluminum alloy, but it may be composed of other equivalently light strong metals such as steel and it may be formed by other methods than extrusion.

Frame member 13 is formed along its entire length with a constant depth groove 19 that is open externally when the frame member is bent to form the head. The width and depth of this groove 19 are greater than the cross sectional size of the strands of the head stringing 20, a string 21 being shown by way of example in FIG. 2.

Metal frame member 13 is of special channel shape with a base 22 and parallel sides 23 and 24 that are formed at or near their free ends with inner ribs 25 and 26. Groove 19 is formed in base 22 by providing a depressed central region 27. A series of spaced stringing holes 28 are formed in the depressed region 27. Frame member 13 is symmetrical about its longitudinal centerline.

The foregoing metal frame strip may for example be that disclosed in U.S. Pat. to Rodgers No. 4,066,260.

A continuous length 31 of synthetic plastic material is disposed between the sides of the inwardly open channel to effectively serve as a core for the frame. As shown core 31 is of constant cross section and may be in the form of an inverted T having side arms 32 and 33 terminating in flat parallel faces 34 and 35 flush with the inner flat parallel faces 36 and 37 of ribs 25 and 26 respectively, and a central leg 38 abutting the inner surface of the depressed region 27 of the channel base. A suitable adhesive is provided between faces 34 and 36 and between 35 and 37, whereby the core 31 is permanently bonded to metal frame member 13 to provide a laminated metal-plastic frame structure. A longitudinal spaced series of string receiving holes 39 is formed in core 31 in the head region of the racquet, and these holes 39 are aligned with holes 28.

Figure 6:
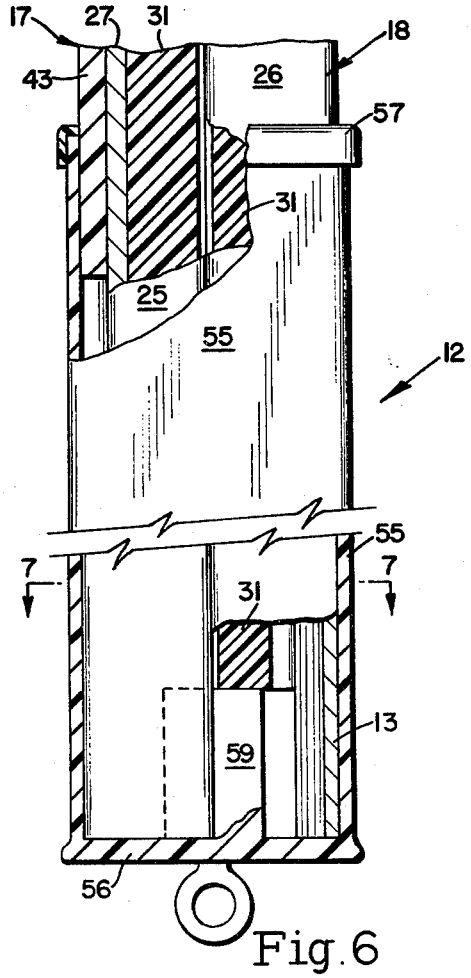
FIG. 6 is a fragmentary side elevation partly broken away and in section showing detail of the handle construction.

Core 31 is coextensive with frame member 13, except for a distance of about one inch at each end, as indicated in FIG. 6. Preferably core 31 is bonded to metal member 13 and the aligned holes 28, 39 drilled.

Figure 1A:
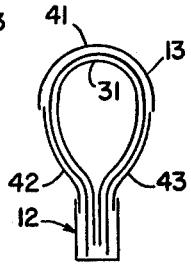
FIG. 1A is a schematic view showing mainly the relative locations of the laminates.

On the outer surface of the racquet head three plastic strips are mounted on the metal frame member, located as diagrammatically indicated in FIG. 1A. One strip 41 extends for about 180° around the outer end of the head. The other two strips 42 and 43 extend from opposite ends of strip 41 through the throat region to a point about one inch into the handle structure as indicated in FIG. 6.

Figure 2:
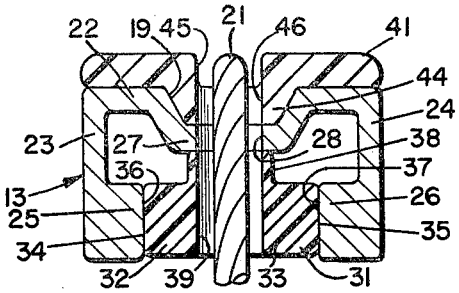
FIG. 2 is a section substantially on line 2—2 of FIG. 1 showing the laminated structure at the outer end of the head.

FIG. 2 illustrates the nature of strip 41. As shown strip 41 extends laterally on both sides of groove 19 so that it is laterally coextensive with base 22 of the channel. Further strip 41 has a continuous central longitudinal region providing a rib projection 44 extending into and occupying groove 19. Aligned with projection 44 strip 41 is formed with a continuous longitudinal externally open recess 45. A series of string passage holes 46 are provided in projection 44 aligned with holes 28 and opening outwardly through strip 41 into recess 45.

Figure 3:
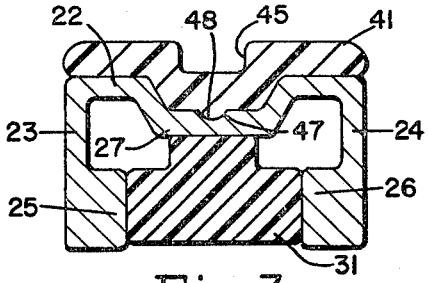
FIG. 3 is a section substantially on line 3—3 of FIG. 1 showing the detent-recess connection between the outer plastic strip and the metal frame member.
Figure 4:
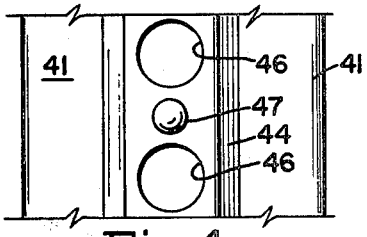
FIG. 4 is a fragmentary view of the inner side of the outer plastic strip of FIGS. 2 and 3, showing the detents and stringing holes.

As shown in FIGS. 3 and 4 a longitudinal series of spaced small locating projections 47 are formed integrally along the inner side of strip projection 44, as between successive holes 46, and projections 47 extend into a corresponding series of depressions 48 formed in the outer surface of the depressed base region 27.

Figure 5A:
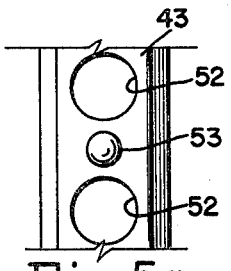
FIG. 5A is a fragmentary view of the inner side of a lower outer plastic strip.
Figure 5:
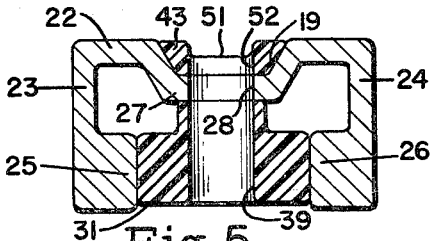
FIG. 5 is a section substantially on line 5—5 of FIG. 1 showing the lower outer strip at one side seated in the outwardly open longitudinal groove on the metal frame member.

FIGS. 5 and 5A disclose the nature of each of the strips 42 and 43, it being understood that these strips may be severed to length from a common extrusion. Strip 43 as shown is shaped in cross section to be disposed substantially entirely within frame groove 19 and it has substantially the same cross section as the projection 44 of strip 41, and it is formed with a continuous externally open longitudinal recess 41 and a series of longitudinally spaces string passage holes 52 aligned with frame holes 28. A series of locating projections 53, similar to projections 47, is disposed between the holes 52. These locating projections 53 fit into spaced depressions 48 at the bottom of groove 19 in the same manner as projections 47.

Strip 42 is substantially identical in shape and size and is similarly disposed in frame groove 19 at the other side from strip 42 as shown in FIG. 1A. The narrower strips 42 and 43 extend from opposite ends of the wider strip 41 to enter the handle structure as shown in FIG. 6.

Figure 7:
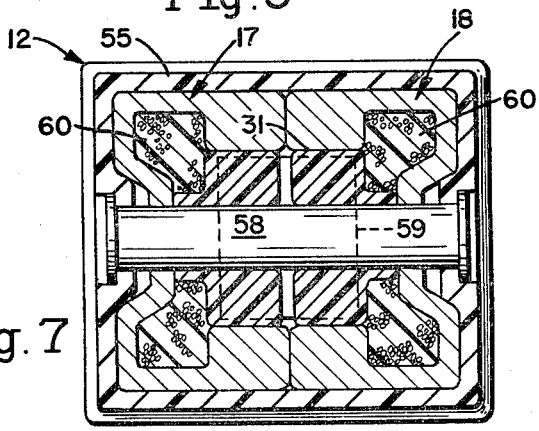
FIG. 7 is a section substantially on line 7—7 of FIG. 6 showing internal structure of the handle.

Referring to FIGS. 6 and 7 the handle 12 comprises a tubular housing 55 having a fixed outer end cap 56. The ends of the laminated frame structure extend snugly within housing 55 to abut the inner surface of cap 56. The other end of the housing mounts a collar 57 frictionally fitted on the open end of the housing 55 and apertured to pass the ends of the laminated frame.

As shown in FIG. 7 the frame ends extend in side by side abutment through housing 55, and a series of rivets such as that shown at 58 rigidly connect the housing 55 and both ends of the laminated frame together.

As shown for strip 43 in FIG. 6, strips 42 and 43 extend only a short distance within the housing, and core 31 extends at opposite ends to terminate short of cap 56 but in end abutment with an integral post 59 upstanding from the cap.

As shown in FIG. 7 the laminated ends of the frame are imbedded in foamed polyurethane or like plastic as indicated at 60 which occupies all of the remaining space within the housing 55.

A suitable conventional wrapping 61 may be provided around the housing 55 as shown in FIG. 1.

In manufacturing the foregoing racquet the preformed metal frame member 13 and the preformed plastic core 31 are preferably assembled and bonded together while both are straight sections of material cut to proper relative lengths. The core is pushed into the channel as shown in FIGS. 2 and 3, with an adhesive coating the flush side faces at 34, 35 and 36, 37, and then the adhesive is cured or otherwise allowed to set the permanent bond. Preferably no adhesive is provided between the end of leg 38 and the metal groove bottom wall 27, thereby allowing free relative movement between them as the bonded laminate may be bent to the head outline.

The laminate 13, 31 is bent about a suitable form to the head outline of FIG. 1 and the opposite ends thrust through collar 57 into housing 55. After riveting the frame ends together the handle is placed in a mold wherein the frame ends are imbedded in foamed polyurethane.

The metal frame member 13 may be of aluminum or other light metal or alloy, or may be formed of stainless steel.

The plastic core member 31 is preferably extruded in desired cross section and may be of ABS, nylon, rigid PVC or polycarbonate. The adhesive bond at faces 34, 35 and 36, 37 is preferably a suitable epoxy or equivalent which is flexible enough to retain the bond while the laminate is being bent to form the head outline.

The plastic strips 41, 42 and 43 similarly may be of the same material as the core member, although for the outer head strip 41 a plastic that is more resistant to abrasion may be used.

In the assembly the outer strip 41, which may be called a bumper strip since it may impact or scrape along a floor or wall during play, and the two strips 42 and 43 are placed in groove 19 before the frame ends are thrust into collar 57, and preferably the fit of projections 47 and 53 into the depressions 48 is a friction snap fit that will retain the strips on the frame while the handle is being attached and during stringing.

After the handle is attached an arcuate throat element 71 is fixed across the throat located and shaped to smoothly complete the boundary of the stringing area of the head. Preferably element 31 is a stiff curved bar of synthetic plastic material secured as by rivets 72, 73 at opposite ends to the frame and it has suitable stringing holes usually lined with smooth ended hollow rivets. Depressions 48 and the projections 47, 53 need not be provided between the throat and the handle.

Stringing is conventional, the strands being passed through the various holes in the frame and the throat element to establish a usual pattern. It has been found that the tensioned stringing coupled with the interfit of strip projections 47 and 53 in the frame depressions 48 is quite adequate to retain strips 41, 42 and 43 in place in the assembly even during strenuous play. An ultimate advantage of this is that the outer head strip 41 which so often is damaged during play may be readily removed and replaced when the racquet is restrung.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a game racquet, a composite metal and plastic frame formed to provide a head defining a stringing section and a handle, said frame comprising a metal strip and synthetic plastic core means, said metal strip being of a cross section to define an internally open channel having a bottom wall and side walls, said core means being disposed substantially entirely within said channel and being permanently bonded to inner surfaces of said channel side walls, means providing an externally open recess in said channel bottom wall extending longitudinally of said bottom wall, a first synthetic plastic strip mounted upon the outer periphery of the channel bottom wall, said first plastic strip being relatively wide and extending laterally over substantially the entire width of said bottom wall around the outer part of the head that is subject to striking stationary surfaces such as a floor or wall during play, an integral longitudinal rib on said first plastic strip extending into and occupying said recess, and two narrow plastic strips that lie substantially within said recess, said narrow plastic strips each having substantially the cross sectional area of said rib and extending along opposite sides of said head between opposite ends of the first wide plastic strip and said handle, each said plastic strip and said means defining said external channel bottom wall recess being formed with stringing holes in said stringing section, and said plastic strips and means defining said external channel bottom wall recess having a spaced series of interfitting locating projections and depressions distinct from said stringing holes along their coextensive lengths.

2. In the game racquet defined in claim 1, tensioned stringing for said head passing through said stringing holes and coacting with said projections and depressions to retain said plastic strips on said head.

3. In the game racquet defined in claim 1, said depressions and interfitting projections having snap fit.

4. In a game racquet, a composite metal and plastic frame formed to provide a head defining a stringing section and a handle, said frame comprising a metal strip and synthetic plastic core means, said metal strip being of a cross section to define an internally open channel having a bottom wall and side walls, said core means being disposed substantially entirely within said channel and being permanently bonded to inner surfaces of said channel side walls, means providing an externally open recess in said channel bottom wall extending longitudinally of said bottom wall and synthetic plastic strip means mounted upon and along the outer periphery of the channel bottom wall, said plastic strip means comprising a relatively wide section that is seated in said recess and extends laterally over substantially the entire width of said bottom wall and narrow sections that lie substantially within said recess, said wide section extending around the outer part of the head that is subject to striking stationary surfaces such as a floor or wall during play and said narrow sections extending between opposite ends of the wide section and said handle, said plastic strip means in the string section having an integral central longitudinal rib projection that extends into said recess and has a cross section substantially equal to that of said narrow strip sections, said plastic strip means and said channel bottom wall being formed with stringing holes in said stringing section and said plastic strip means and said channel bottom wall having a spaced series of interfitting projections and depressions along their coextensive lengths, and said depressions being formed along said recess and being located between stringing holes, with said rib projection being correspondingly formed with said spaced depression interfitting projections.

* * * * *